US005632575A

United States Patent [19]

Lorenzen et al.

[11] Patent Number: 5,632,575

[45] Date of Patent: May 27, 1997

[54] METHOD AND APPARATUS FOR CONTROLLED PUMPING OF BENTONITE AROUND A PIPE JACKED TUNNEL

[76] Inventors: Frank J. Lorenzen, 900 4th St. SW., Austin, Minn. 55912; Mark Guterman, 2015 41st St. NW., Apt. J40, Rochester, Minn. 55901

[21] Appl. No.: 298,392

[22] Filed: Aug. 30, 1994

[51] Int. Cl.[6] ..... E21D 11/00

[52] U.S. Cl. ..... 405/184; 299/33; 405/146; 405/154

[58] Field of Search ..... 405/146, 150.1, 405/151, 184, 269, 132, 133; 299/31–33

[56] References Cited

U.S. PATENT DOCUMENTS

| | | | |
|---|---|---|---|
| 1,378,158 | 5/1921 | West et al. | 405/151 |
| 3,969,906 | 7/1976 | McBean | 405/146 |
| 4,116,011 | 9/1978 | Girault | 405/135 |
| 4,176,985 | 12/1979 | Cherrington | 405/154 X |
| 4,226,557 | 10/1980 | Kayahara | 405/269 |
| 4,233,015 | 11/1980 | Teague et al. | 405/269 X |
| 4,363,565 | 12/1982 | MacKenzie | 405/146 |
| 4,637,756 | 1/1987 | Boles | 405/154 X |
| 5,129,762 | 7/1992 | Legendre | 405/232 |

OTHER PUBLICATIONS

Thomson James, Pipejacking and Microtunneling, 1993, Great Britain, Blackie Academic & Professional.

*Primary Examiner*—Dennis L. Taylor
*Attorney, Agent, or Firm*—Mark D. Stignani

[57] ABSTRACT

An apparatus and method for selectively injecting a liquid bentonite slurry around an exterior of a tunnel liner segment which is pressed into a tunnel being concurrently excavated during a pipe jacking installation. The bentonite slurry lubricates the exterior of the tunnel liner reducing the force required to press the tunnel liner into the tunnel. The apparatus allows an operator of the pipe jacking operation to selectively inject bentonite around individual tunnel liner segment or to allow the apparatus to selectively inject bentonite as required by a preset injection pressure threshold value.

10 Claims, 8 Drawing Sheets

METHOD AND APPARATUS FOR CONTROLLED PUMPING OF BENTONITE AROUND A PIPE JACKED TUNNEL

COPYRIGHT RESERVATION

A portion of the disclosure of this patent document contains material which is subject to copyright protection. The copyright owner has no objection to the facsimile reproduction by anyone of the patent document or the patent disclosure as it appears in Patent and Trademark Office patent files or records, but otherwise reserves all copyright rights whatsoever.

FIELD OF THE INVENTION

The present invention relates to the field of pipe jacking. More specifically, the present invention relates to the controlled lubrication of the exterior of pipe jacked tunnel sections with a bentonite pumping system.

BACKGROUND OF THE INVENTION

Trenchless tunneling methods that create a tunnel by excavating of the tunnel while concurrently pressing or "jacking" a tunnel casing or liner into the newly excavated tunnel are well known. The methods of pipe jacking, auger boring and microtunneling all use a hydraulic ram for pushing a series of tunnel liner sections end to end into the tunnel forming a tunnel lining behind a tunneling excavation. The typical pipe jacking site includes a pit which is dug to a depth to which a pipe or a tunnel liner will be placed under a section of ground. A set of equipment used in the pit will include a hydraulic ram, a soil hauling device for removing a quantity of soil from the tunnel excavation face, a excavation device, a backstop for the ram to push against and sufficient space to lower a section of the tunnel liner into place. Outside the pit, a second set of support equipment will typically include a crane for lowering sections of pipe or tunnel liner and lifting excavated soil from the pit, digging equipment, and a set of various support equipment. The crew will include personnel working inside the pit and on the ground surface. The typical crew size is five persons in the pit, tunnel and above ground.

The tunnel excavation may be performed by a human using hand labor, a combination of human hand labor assisted by machine excavation, or a fully automated tunnel boring machine (TBM). By excavating and lining the tunnel concurrently, a tunnel cave-in or other dangers of the tunnel's unsupported faces are reduced. The tunnel excavation diameter is typically cut slightly larger than the tunnel liner sections to minimize compression of tunnel sections as they are pressed down the tunnels length.

Various tunnel liner cross section geometries have been used. Tunnel liner cross-sections have ranged from a rectangular shape to a circular shape. The tunnel liner section ends must match or link into the end of another similar tunnel liner section. A principal requirement of the tunnel liner section design is its capacity to withstand compressive stress from the hydraulic ram which presses the tunnel liner section into the tunnel. Each section after being pressed into the tunnel is then forced deeper into the tunnel by the next section inserted by the hydraulic ram. As each section is pressed by the ram, the previously inserted sections extend deeper into the tunnel forming the full tunnel liner.

As the tunnel liner receives more tunnel sections, the friction between each tunnel section's exterior surfaces and the surrounding soil structure accumulates. This accumulated friction forces the hydraulic ram to increase the amount of force required to press each additional tunnel section into the tunnel. The material strength of the tunnel section and an upper pressing limit of the hydraulic system "jacking" the tunnel sections limit the amount of force that can be applied to the tunnel sections. Thus, a method of reducing the friction is required to increase the length of the tunnel past these friction limitations. A method of lubricating the tunnel sections, is used that injects a slurry containing a composition called bentonite around tunnel sections as they are pressed into the tunnel at the hydraulic ram. Other methods also inject bentonite into the tunnel sections farther down the tunnel as the bentonite is lost or absorbed by the ground. Bentonite is a water and clay composition containing a potassium, calcium, or sodium montmorrillonite clay that exhibits thixotropic properties. A thixotropic property is a substance which is a liquid when agitated and returns to a gel state after agitation ceases. Industry calculations have estimated that lubrication of tunnel sections increases the length of tunnel sections that are insertable in a single tunnel by a thousand times based on the load attributable to friction. In industry studies, it is surmised that a gel layer which is formed by injecting sufficient thixotropic material around the exterior of the tunnel section will cause the tunnel sections to become "buoyant" and float on this gel layer as they are pressed into the tunnel. Experimental data indicates that this floating condition keeps the hydraulic forces required to press additional tunnels sections at roughly a constant value in loose soil and gravel below the water table.

Bentonite pumping is currently done in stages; the bentonite is mixed in a grout mixing unit, the bentonite is formed into a slurry or grout which is then transferred to a pumping station which is hand linked to orifices or hand operated valves that are located at an entrance or mouth of the tunnel or at several tunnel sections within the tunnel length. The valves are turned on by personnel in the tunnel if the tunnel is sufficiently large to admit a human. The preparation, pumping and distribution of the bentonite is largely dispersed and separate from the tunneling operation and requires additional personnel to operate and maintain the lubrication of the tunnel sections. Some integration has occurred by combining the mixing and pumping of the bentonite in the Akkerman bentonite pump model EH-2250. The EH-2250 eliminates the separate above ground mixing and pumping units and delivers a consistent and uniform bentonite slurry to the delivery point. The other aspects of bentonite delivery still require separate manpower intensive operations and require a crew member on a pipe jacking crew to implement bentonite pumping. The crew member has tasks of filling the mixing reservoirs with water and dry bentonite, operating the mixers, operation of the distribution pumping system and operation of tunnel valves. Once the tunnel is finished, a worker must to enter the tunnel to remove the conduit from the tunnel liner and to plug the holes that the bentonite was pumped through. This bentonite lubrication technique is limited to human sized tunnels.

Therefore, there is a need to provide bentonite lubrication in a trenchless tunneling operation that reduces manpower requirements and is a safe and efficient manner and mode of bentonite distribution over the current methods. There is also a need to provide selectively dispensed bentonite in tunnels which are too small for human entry

SUMMARY OF THE INVENTION

An apparatus and method for selectively injecting a liquid bentonite slurry around an exterior of a tunnel liner segment which is pressed into a tunnel being concurrently excavated during a pipe jacking installation. The bentonite slurry lubricates the exterior of the tunnel liner reducing the force required to press the tunnel liner into the tunnel. The apparatus allows an operator of the pipe jacking operation to selectively inject bentonite around individual tunnel liner segment or to allow the apparatus to selectively inject bentonite as required by a preset injection pressure threshold value.

DETAILED DESCRIPTION OF THE INVENTION

Figure 1:
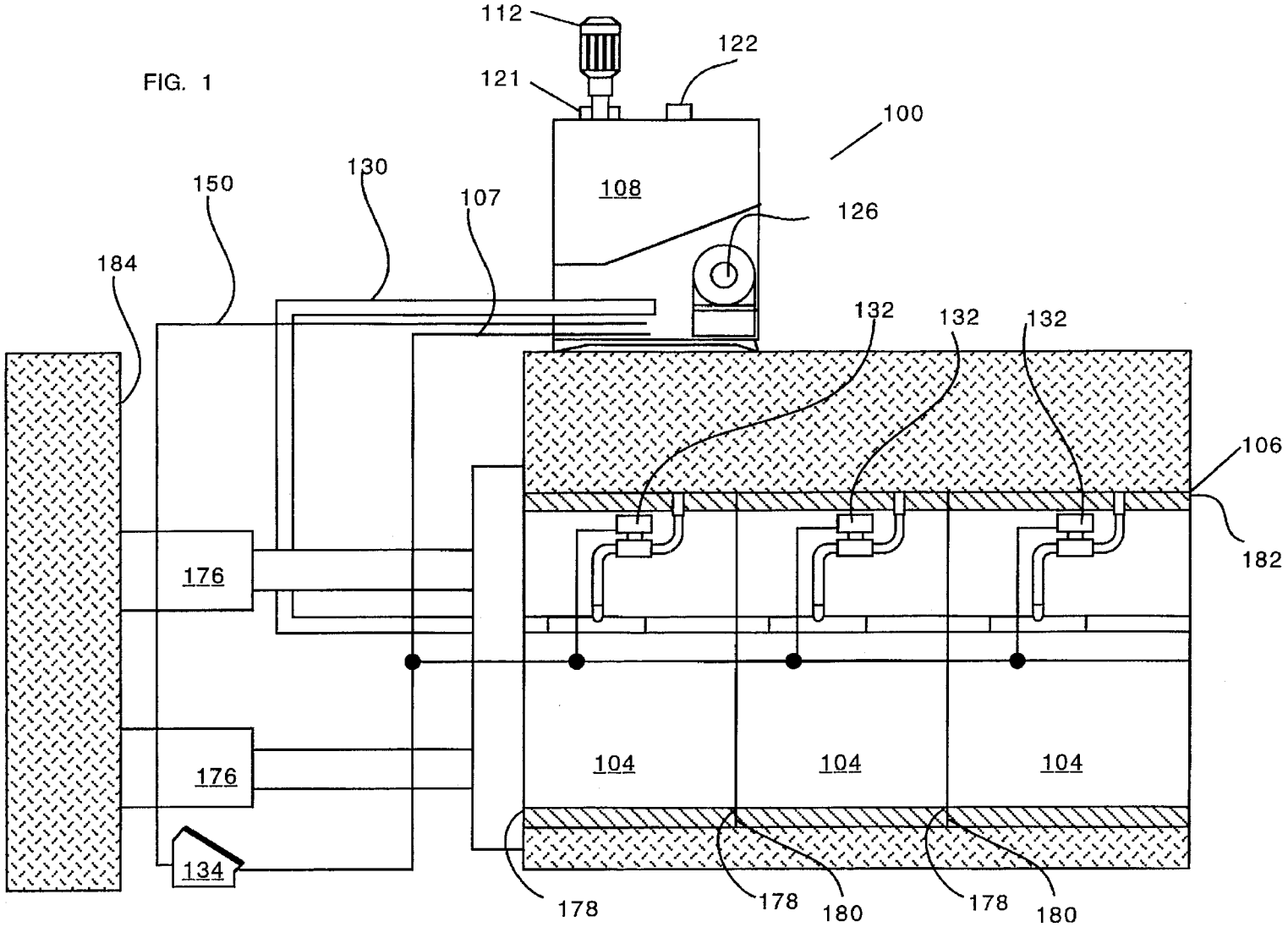
FIG. 1 is a cross section view of the present invention used in a typical pipe jacking operation.
Figure 2:
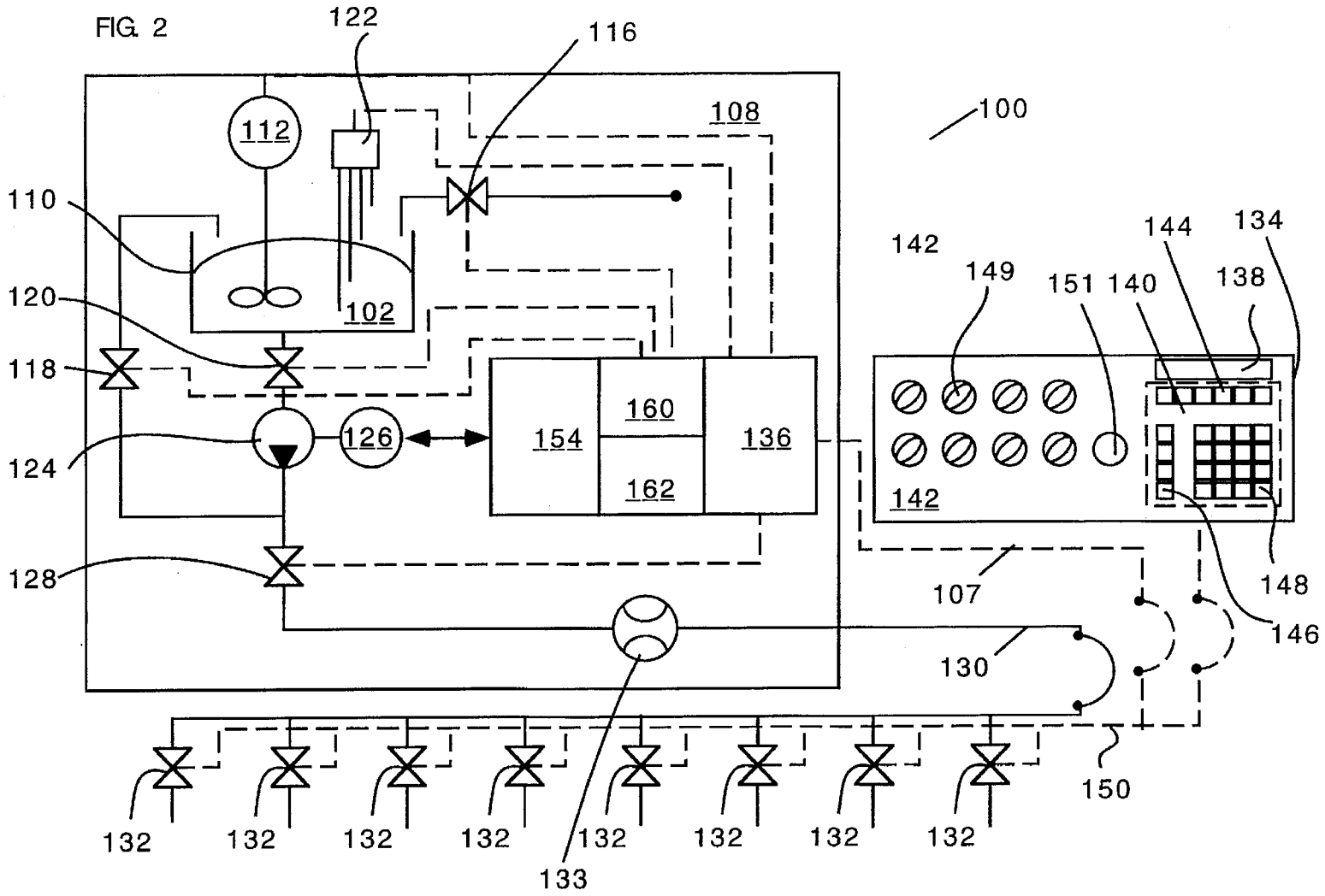
FIG. 2 is a system diagram schematic of the present invention.

In FIGS. 1,2 a bentonite pumping system is shown, indicated generally at 100, for pumping a quantity of bentonite slurry 102 around a tunnel liner 104 being pressed into a concurrently excavated tunnel 106. System 100 includes a pumping unit 108, mounting at least a single bentonite tank 110, a mixer motor 112, connected to a mixer mechanism 114 located inside the bentonite tank 110. Bentonite tank 110 includes a water input valve 116, a return line valve 118, a suction valve 120, an opening for the addition of dry bentonite powder 121 and a tank level sensor 122. The suction valve 120 is connected to a distribution pump 124 that is driven by a pump motor 126. The distribution pump 124 is connected to the return line valve 118 and an output valve 128. The output valve 128 is connected to a conduit 130 to a tunnel valve 132. A flow meter 133 on the conduit 130 monitors the amount of bentonite slurry 102 being pumped to the tunnel valve 132 in the tunnel 106.

System 100 includes a remote operation capability that includes a display unit 134 connecting via a control line 107 to a programmable controller (PLC) 136 in the pump unit 108. Display unit 134 displays specific status parameters of system 100 to a system operator (not shown.) Display unit 134 has a display screen 138 and a keypad 140 enclosed in a display housing 142. Display unit 134 also directs PLC 136 to control the speed of pump motor 126 via a variable frequency motor controller 154. The display unit 134 also directs the PLC 136 to control the mixer motor 112 and valves 116,118,120,128 by selecting bentonite slurry 102 mixing, recirculating or dispensing modes of operation for the pump unit 108.

Figure 3:
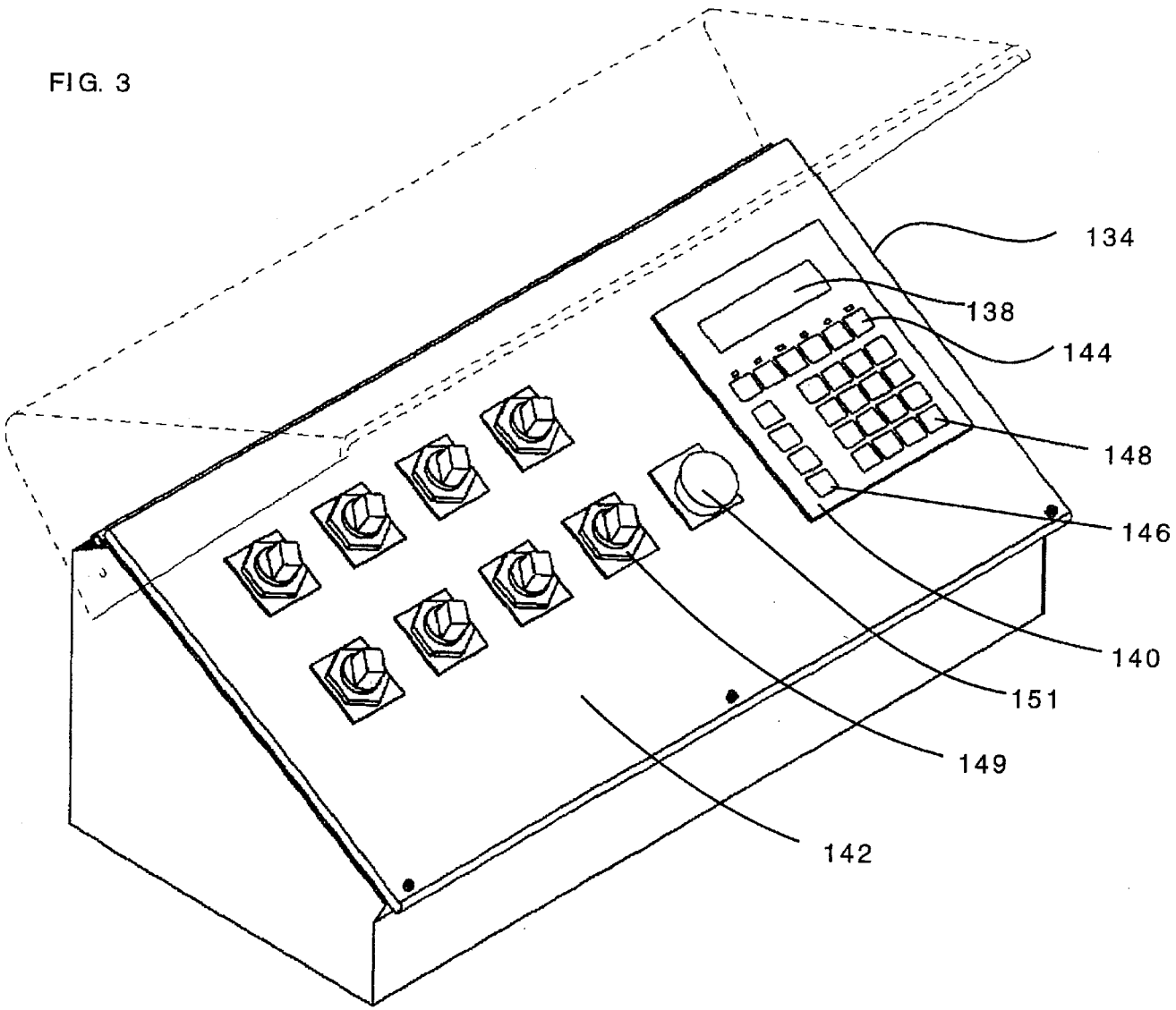
FIG. 3 is an isometric view of a display unit of the present invention.

In FIG. 3, the operator display unit 134 has an alphanumeric display screen 138 including at least a set of two alphanumeric display lines. The display unit 134 informs the operator of the status conditions of the bentonite pumping system 100. The operator is given warnings and override options in a series of visual displays on the screen 138 if the PLC 136 detects a anomalous condition in the system 100. Examples of display screen 138 may include commercially available displays using liquid crystal displays, light emitting diode displays or other appropriate display formats. Keypad 140 includes a set of function keys 144, a set of cursor keys 146 and a set of numeric keys 148. Function keys 144 allow the operator to select and control a series of bentonite pumping system 100 parameters by selecting one of the function keys 144. Operator controls individual tunnel valves 132 with a set of individual switches 149 that activate the tunnel valves 132 via a set of signal control lines 150 to inject bentonite slurry 102 through the tunnel liner 104. The display unit 134 also has an emergency shutdown switch 151 to shutdown the whole system 100 should the need arise. The bentonite pumping system 100 has several functions available to the operator for control including, individual control of the tunnel valves 132, individual control of the mixing mechanisms 114, proportional control of the distribution pump 124 speed which controls the flow rate of the bentonite slurry 102, modal control of tank valves 118,120, 128 by way of selecting mixing and pumping modes for the dual tanks 110. System 100 allows the operator to monitor parameters including all positions(open/closed) for each valve 116,118,120,128 in the bentonite pumping unit 108, the amount of bentonite slurry 102 pumped to the tunnel valves 132 during a desired period, and the level of bentonite slurry 102 present in either of the tanks 110. The level sensor 122 is polled by the PLC 136 on a periodic basis to alert the operator of low bentonite slurry 102 levels in tank 110 and to protect pump 124.

PLC 136 controls the system 100 devices based on a series of programs inherent to the PLC 136 and command inputs from the display unit 134. PLC 136 is a digitally operating electronic apparatus that uses a programmable memory for storing an internal set of instructions that implement a specific set of output functions. An example of a PLC 136 representative of the type of PLC 136 used in the present invention is a Mitsubishi Model FX-48MR-UA1/UL with analog input and output blocks. The present invention's PLC 136 continuously monitors and receives digital and analog input signals from system 100 devices that are connected to the PLC 136 as inputs. Inputs include status of valves 116,118,120, 128,132, the level status of tank 110 from level sensor 122, motor status from motors 112, 126, flow rate of bentonite slurry 102 from flow meter 133 and commands from display unit 134. Following the set of instructions in memory, the PLC 136 controls the status of the system 100 devices which are connected to the PLC 136 as outputs. Outputs include actuation of valves 116,118,120, 128, control of motors 112,126, the reset command for flow meter 133 and acknowledgment of commands from display unit 134. PLC 136 has a digital to analog conversion interface 160 for controlling the status of devices requiring an analog control signal and an analog to digital conversion interface 162 for interpreting an analog signal from system 100 devices that the PLC 136 monitors.

Figure 4:
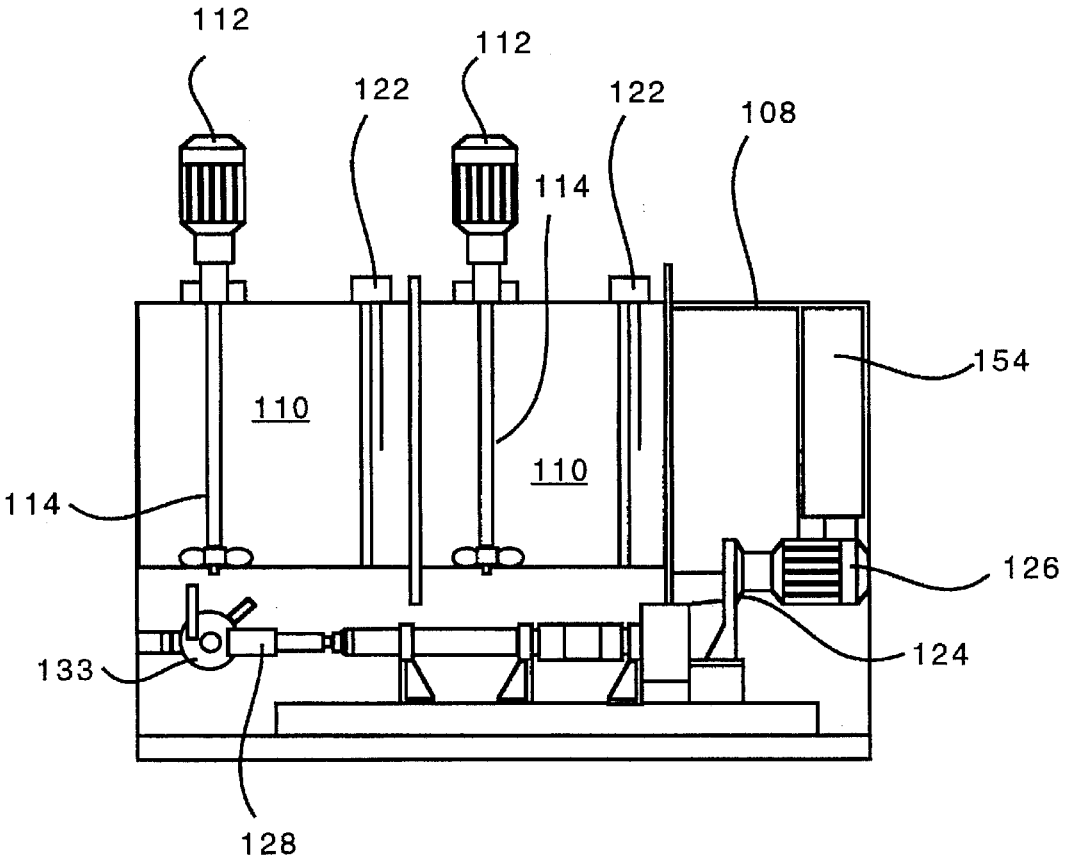
FIG. 4 is a cross section view of an embodiment of a pumping unit of the present invention.

In FIG. 4, another embodiment of the pump unit 108 holds a dual bentonite tank 110 vertically disposed with the mixer mechanism 114 suspended into the tank 110 with the mixer motor 112 mounted on the bentonite tank 110. Each tank 110 has identical equipment to the single tank 110 configuration shown in FIG. 1 with the exception that the dual tanks 110 share the distribution pump 124. The tanks 110 are interconnected to allow either of the return line valves 118 to receive the contents of either tank 110 from the distribution pump 124. This embodiment of the present invention has an additional mode of operation of allowing pumping of bentonite slurry 102 between tanks 110. The use of dual tanks 110 allows one tank 110 to mix new bentonite slurry 102 while the other tank 110 is used to delivery ready bentonite slurry 102 to the tunnel valves 132. The dual tanks 110 allows the steady and continuous delivery of bentonite slurry 102. Bentonite slurry 102 is removed from either tank 110 through each tank's 110 suction valve 120. The suction valve 120 is an electrical step motor driven ball valve. An example of a ball valve of this type would be the Apollo 71-148-01/EVA-40. Once the suction valve 120 is open, the distribution pump 124 is activated by the PLC 136 to draw bentonite slurry 102 from the tank 110. Depending on whether the display unit 134 requests recirculation or tunnel pumping, the PLC 136 will either open either return line valves 118 or the output valve 128 which are also electrical step motor driven ball valves similar to the type used by the suction valve 120. If the return valves 118 are open, then the pump unit 108 is in a recirculation mode of operation. If only one return valve 118 is open, then the pump unit 108 is transferring bentonite slurry 102. If the outlet valve 128 is open, the distribution pump 124 is pumping bentonite slurry 102 to the tunnel 106. The distribution pump 124 is a screw type pump 124 that is driven by a variable speed motor 126. An example of this style of pump 124 is the Moyno L6 pump. The variable frequency motor controller 154 allows the distribution pump 124 to pump bentonite slurry 102 at varying rates. The flow meter 133 measures the flow rate of bentonite slurry 102 flowing through the conduit 130. The flow meter 133 information is displayed on the display unit 134 and is used by the operator to control the distribution pump 124 output rate.

Figure 5:
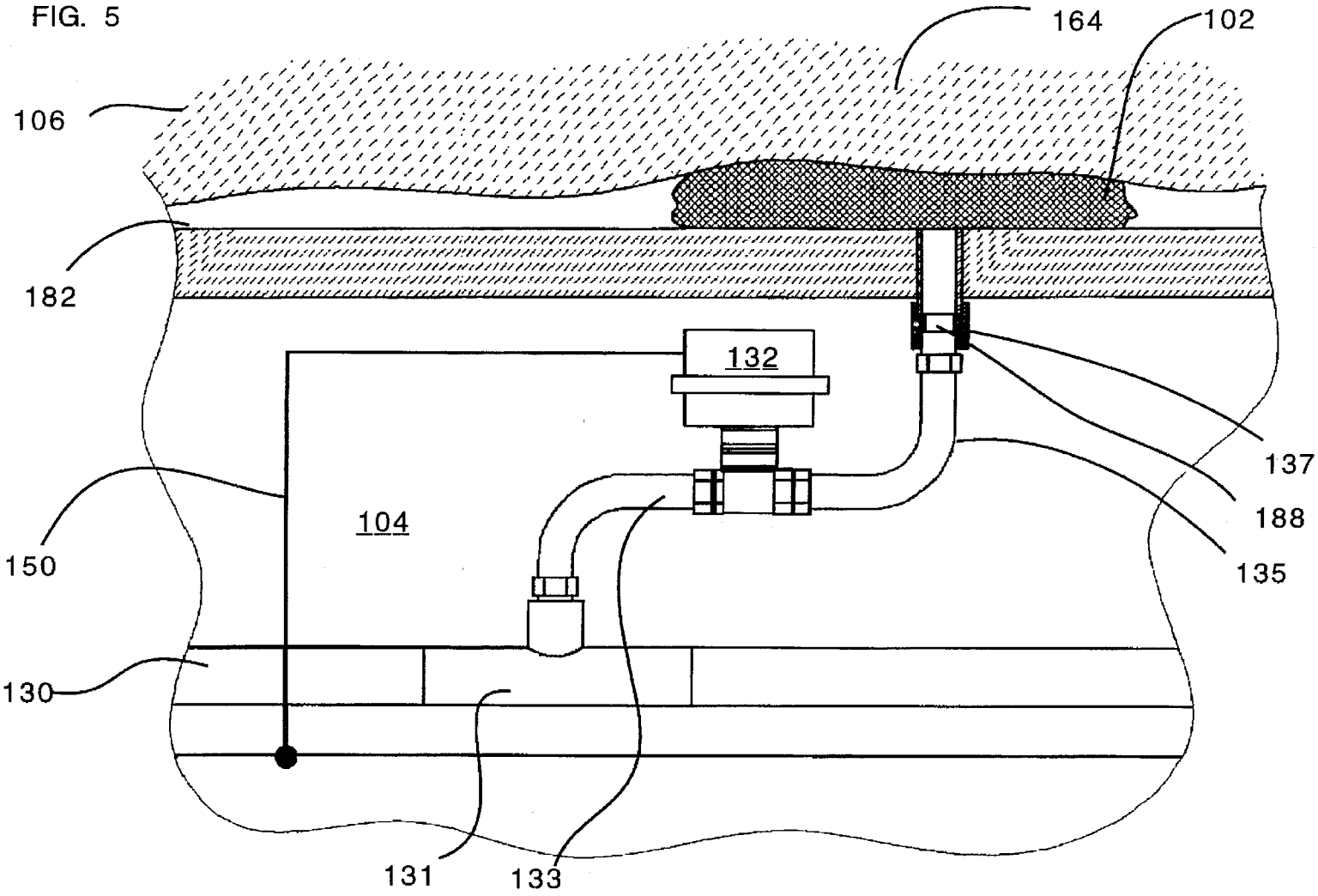
FIG. 5 is a detail of an embodiment of the present invention showing a tunnel valve installation.

In FIG. 5, the conduit 130 carrying bentonite slurry 102 mounts to the tunnel valves 132 of an electrical step motor driven ball valve similar to the type used in the suction valve 120. The tunnel valve 132 has two positions, an open or closed position which are commanded in this embodiment by the operator. The tunnel valve 132 is disposed on a upper internal surface 164 of the tunnel liner 104 segment. The bentonite slurry 102 is transported to the tunnel valve 132 through conduit 130. The tunnel valve 132 is attached to the conduit 130 by a tee connection 131 and a flexible conduit 133. The bentonite slurry 102 passes through the open tunnel valve 132 into a second flexible conduit 135 to a sleeve 137 that passes through the tunnel liner 104 wall. The bentonite slurry 102 is deposited between an exterior surface 182 of tunnel liner 104 and the tunnel wall 106. The tunnel valve 132 connected to the display unit 134 via the control line 150. The sleeve 137 provides a connection point for the conduit 135 and must be closed off after the tunnel 106 is finished and the bentonite system 100 is removed.

Figure 6:
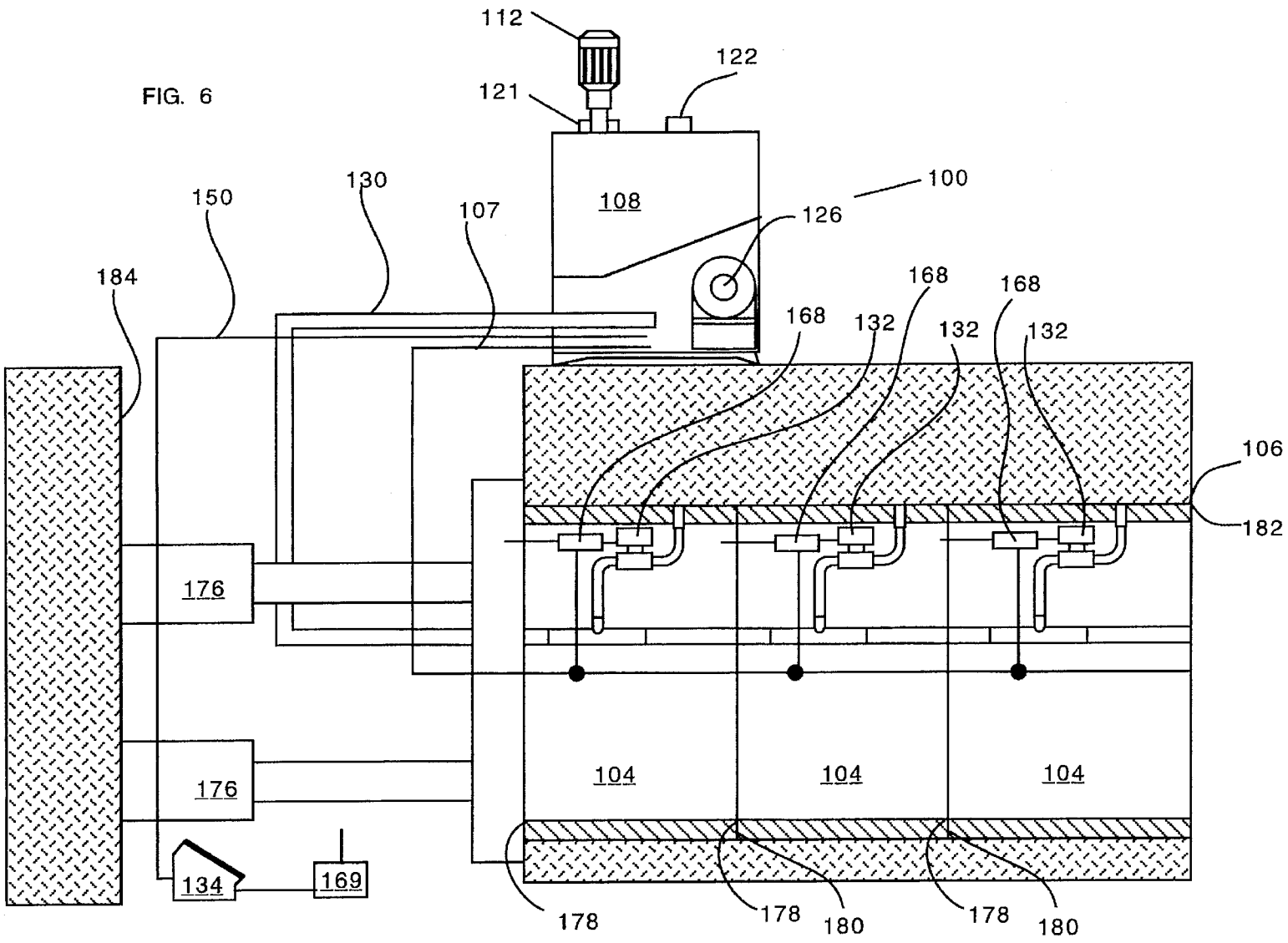
FIG. 6 is a cross section view of a typical pipe jacking operation using a wireless tunnel valve embodiment of the present invention.

FIG. 6 is a cross-sectional view of the tunneling operation utilizing a set of wireless telemetry transmitters 168 to send and receive a set of valve position actuation commands and feedback signals to a base station 169. Examples of the transmitter 168 include a wireless, infrared, radio or other suitable non-wired transmissions that receive and transmit the control commands and signal responses to the base station 169 which in turn transmits to the PLC 136 or the display unit 134. Transmitter 168 on each tunnel valve 132 may be individually or group addressable by the PLC 136. The telemetry transmitter 168 increases the system 100 reliability by eliminating the need to string individual control lines 150 to each tunnel valve 132 from the display unit 134. This embodiment of bentonite pumping system 100 shows the use of a single power feed in control line 150 that connects in parallel to each tunnel valve 132. The single power feed 150 does not carry any control signals.

Figure 7:
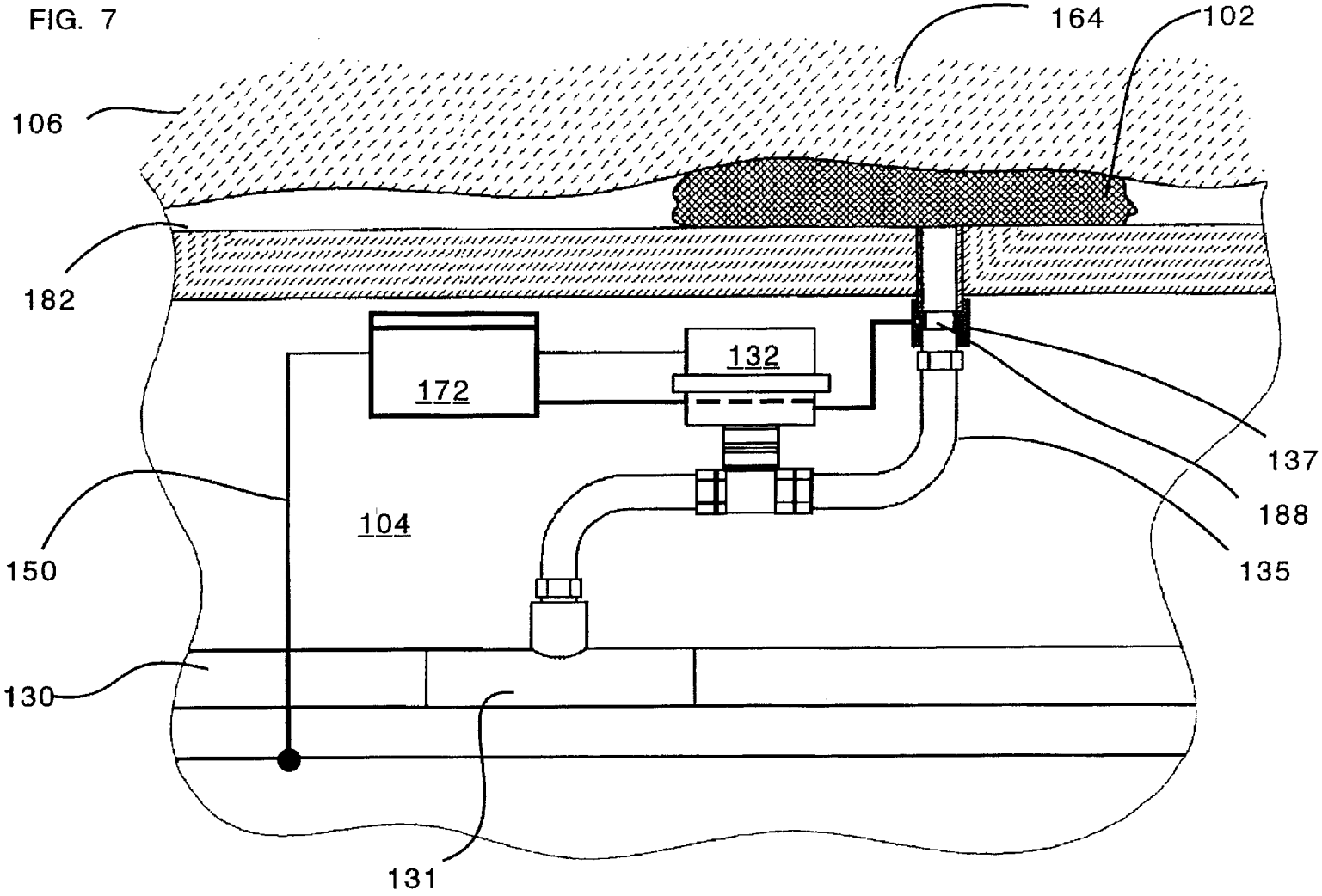
FIG. 7 is a detail of an embodiment of the present invention using a pressure sensing tunnel valve installation.

FIG. 7 is an embodiment of the bentonite pumping system 100 that uses a pressure sensor 188 located coincident to the sleeve 137. The pressure sensor 188 is located in a manner to sense the pumping pressure required to inject bentonite slurry 102 through the sleeve 137 between exterior 182 and the tunnel 106. Examples of pressure sensors configurations may include semiconductor, diaphragm, strain gage or other forms of pressure sensors that are appropriate for the bentonite pumping system 100 environment. The sensed pressure is then fed to a valve controller 172 which will adjust and actuate the tunnel valve 132 based on the sensed pressure. The valve controller 172 may be a programmable logic controller similar to the PLC 136, but limited in power and scope of functionality. The valve controller 172 will open the tunnel valve 132 when the sensed pressure of the bentonite slurry 102 is below a value set by the system operator. The tunnel valve 132 will also self-close if the injected bentonite slurry 102 sensed pressure is above a value set by the system operator. This embodiment is a full automation of the bentonite pumping process and has the advantage of maintaining a constant supply of bentonite slurry 102 based on pressure at each sleeve 137 location in the tunnel liner 104. The bentonite pumping system 100 also has a capacity to alert the operator of likely sites where an inordinate amount of bentonite slurry 102 is being pumped out of a single or series of tunnel valves 132. This will allow the operator to react to a possible problem by cutting off the bentonite slurry 102 flow to the affected tunnel valves 132 or to boost the pumping rate of the pump 124 to compensate for the lost bentonite slurry 102. This embodiment of the present invention will allow correlation of changes in the bentonite slurry 102 pressure to be matched against a set of soil or ground types that are encountered at throughout the tunnel 106 excavation.

Figure 8:
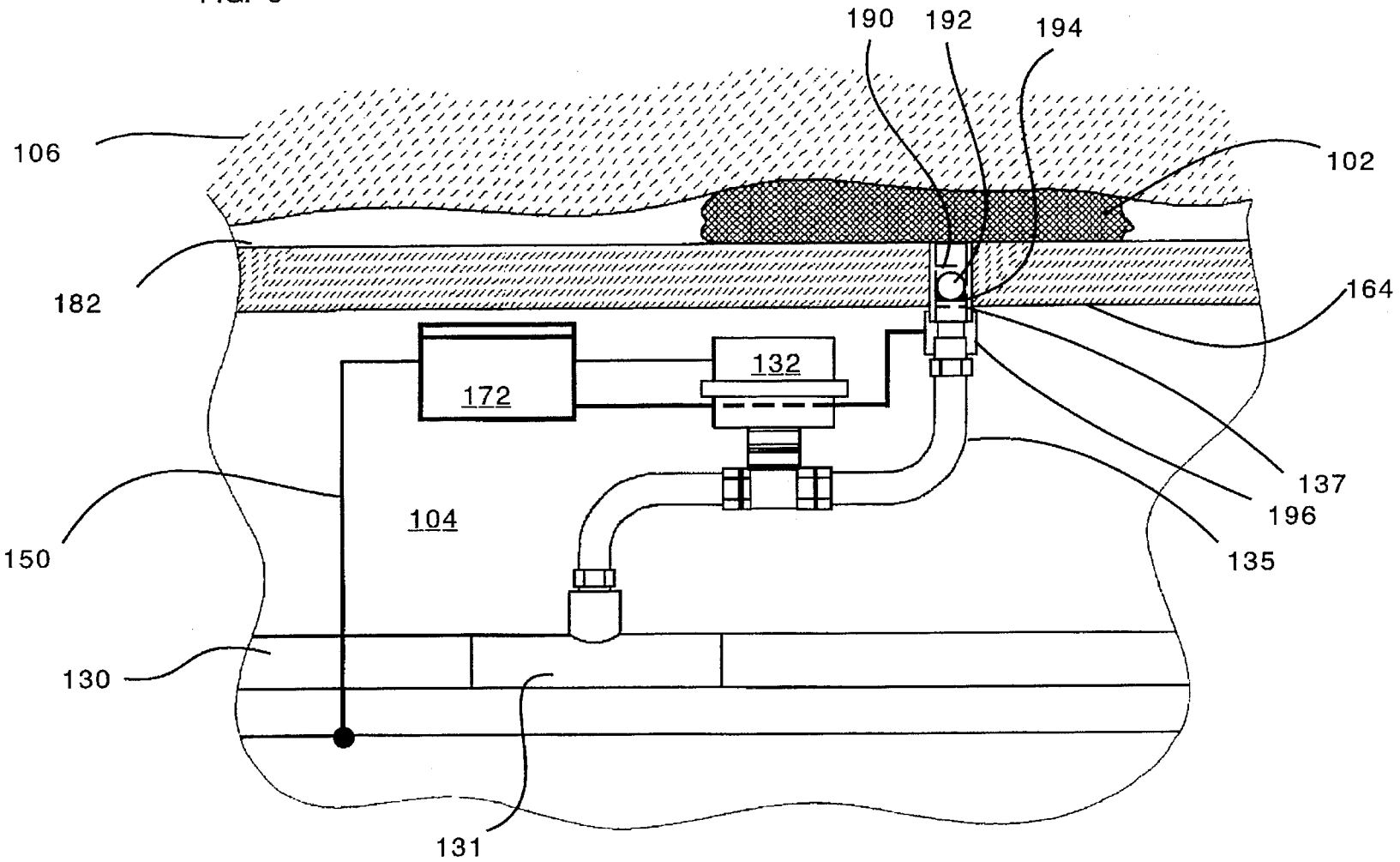
FIG. 8 is a detail of an embodiment of the present invention showing a self releasing tunnel valve.

In FIG. 8, shows an embodiment of a tunnel valve 132 used in microtunneling operations where the tunnel liner 104 is smaller than human sized. In the present invention, sleeve 137 includes a check valve 190 that only allows the flow of bentonite slurry 102 into and around the exterior 182 of the tunnel liner 104 segment from the tunnel valve 132. The check valve 190 construction included a ball 192 that reseats into a socket 194 when the pumping pressure of the bentonite slurry 102 drops below a set pressure sealing off the sleeve 137. Once the pumping operation is completed, a self releasing connector 196 between the sleeve 137 and the second flexible conduit 135 will disconnect upon operator command from the tunnel liner 104 when the tunnel 106 is completed. Examples of self releasing connector 196 include a solenoid compressed detente release, an electromagnetically interlocked collar, a pilot operated hydraulic collar, an electrically interlocked collar or other suitable remotely actuated devices. By allowing the retrieval of nearly all of the components of the bentonite pumping system 100, the self releasing connector 196 make bentonite pumping in the smaller diameter tunnels 106 practical and feasible. Connector 196 allows the remote or automated bentonite pumping and lubrication of tunnel liner 104 diameters as small as eighteen inches.

The method of bentonite lubrication in a pipe jacking operation is shown in FIG. 1. The bentonite slurry 102 is mixed in the tank 110 from a quantity of dry bentonite powder (not shown) input by a crew member (not shown) and a quantity of water (not shown) input by the water input valve 116. The mixing is performed by mixer mechanism 114 which keeps the bentonite slurry 102 in a liquid state by constant agitation. The bentonite slurry 102 is pumped out of the tank 110 by the distribution pump 124 to the conduit 150. Bentonite slurry 102 is pumped through the conduit 150 to tunnel valve 132 that is placed in a tunnel liner 104 segment. In a pipe jacked tunnel 106, tunnel liner 104 segments are pushed one segment at a time into a concurrently excavated tunnel 106 by a hydraulic ram 176, each tunnel liner 104 segment back end 178 to the next tunnel liner 104 segment front end 180. Tunnel valve 132 output extending through tunnel liner 104 segment wall to an exterior surface 182. Bentonite slurry 102 is pumped out through tunnel valve 132 to the tunnel liner exterior 182. Bentonite slurry 102 flows around and lubricates the tunnel liner exterior 182 decreasing surface friction between earth tunnel 106 and the exterior surface 182 of the tunnel liner 104 segment. As the tunnel liner 104 is pushed farther into the tunnel 106, the bentonite slurry 102 is expended or lost and must be replaced. Tunnel valves 132 are distributed along the tunnel 106 to supply bentonite slurry 102 to the length of the tunnel 106. The bentonite pumping system operator (not shown) is located in a tunneling pit 184 that contains a hydraulic ram 176. The display unit 134 used by the operator is connected to the rest of the bentonite pumping system 100 outside the pit 184 with control line 107.

The present invention describes a bentonite pumping system 100 that is configurable in both a remote control and in an automated control mode. The remote control mode is an open loop control solution that relies on the skill and expertise of the operator utilizing the bentonite pumping system 100 to gauge the amount and pressure of bentonite slurry 102 pumped into the tunnel 106. The remote method eliminate the task of bentonite mixing and reduces the number of operators in a pipe jacking crew by one. The operator is able to coordinate the jacking and the bentonite pumping to improve the quality and quantity of lubrication available for jacking each section of tunnel liner. The automated control system closes the control loop by sensing the feedback pressure at the sleeve 137 and providing a constant pressure flow of bentonite slurry 102 through out the length of the tunnel liner 104. The automated system 100 eliminates the need for any operator with the exception of replacing the bentonite slurry 102 in the mixing tanks 110 as the supply runs low.

The manner and content of the present invention disclosed herein is described with reference to preferred embodiments. Workers skilled in the art will recognize that changes may be made in form and detail without departing from the spirit and scope of the invention.

What is claimed:

1. A bentonite distribution system for lubricating a tunnel liner surface with a quantity of bentonite slurry as the tunnel liner is pressed through a tunnel, comprising:

a tank for holding the bentonite slurry, the tank having a selectively operable mixer mechanism for agitating the bentonite slurry, the tank having an opening for input of a quantity of dry bentonite and an opening with a selectively operable tank valve for input of a quantity of water and an opening with a selectively operable tank valve for output of the agitated bentonite slurry;

a selectively operable pump for drawing the bentonite slurry from the tank, an input for the pump fixedly attached to the output of the tank, an output of the pump fixedly attached to a conduit extending into the tunnel;

a selectively operable tunnel valve, the tunnel valve input fixedly attached to the conduit, the tunnel valve disposed on the tunnel liner, an output of the tunnel valve extending through a wall of the tunnel liner discharging the bentonite slurry to an exterior surface of the tunnel liner; and a control device, the control device inputs fixedly connected to the tank valve and the tunnel valve and the pump and the mixer mechanism, the control device monitoring each input for status, the control device output selectively controlling the tank valve and the tunnel valve and the pump and the mixer mechanism.

2. The bentonite pumping system in claim 1 where a display unit having a display and a keypad, is connected to the control device, the display unit receiving a set of inputs representative of the control device inputs from the control device, the display displaying an set of information representative of the inputs to an operator, the display unit output selectively controlling the control device with a set of operator inputs from the keypad.

3. The bentonite pumping system in claim 2 where the display unit directly controls the tunnel valve.

4. The bentonite pumping system in claim 2 where the control device is a programmable controller (PLC).

5. The bentonite pumping system in claim 1 where a pair of interconnected tanks are used for holding the bentonite slurry, the tanks selectively mixing and dispensing the bentonite slurry to either tank or to the tunnel valve.

6. The bentonite pumping system in claim 2 where the tunnel valve further comprises:

a pressure sensor for sensing a pressure required to inject the bentonite slurry through a tunnel liner wall access to an exterior tunnel liner surface; and a valve controller fixedly disposed on the tunnel valve, the input of the valve controller is the sensed pressure of the injected bentonite slurry, the output of the valve controller selectively opening the tunnel valve to inject another quantity of the bentonite slurry if the sensed pressure drops below a set level.

7. The bentonite pumping system in claim 2 where the tunnel valve is selectably controlled by a wireless transmitted signal from the display unit.

8. The bentonite pumping system in claim 1 where the tunnel valve output is removably connected to a check valve sleeve fixably attached through the tunnel liner wall, the sleeve allowing a one way flow of bentonite slurry to the tunnel liner exterior.

9. The bentonite pumping system in claim 8 where the tunnel valve is remotely removable from the tunnel after the tunnel is completed, the sleeve remaining in the tunnel liner wall.

10. A method for lubricating a tunnel liner surface with a quantity of bentonite slurry as the tunnel liner is pressed into a tunnel using a bentonite distribution system, steps comprising:

mixing the bentonite slurry in a mixing tank until the bentonite slurry achieves a liquid state;

pumping the liquid bentonite slurry through a conduit into the tunnel;

dispersing the liquid bentonite slurry to a series of selected tunnel liner segments throughout the length of the tunnel; and selectively injecting the liquid bentonite slurry through an access in a wall of the tunnel liner segment to the exterior of the tunnel liner.

* * * * *